US008053961B2

(12) United States Patent
Wang et al.

(10) Patent No.: US 8,053,961 B2
(45) Date of Patent: Nov. 8, 2011

(54) COLOR-MIXTURE DISPLAY UNIT AND IMAGE DISPLAY APPARATUS USING THE SAME

(75) Inventors: Bily Wang, Hsin Chu (TW); Hui-Chung Lin, Chia I Hsien (TW)

(73) Assignee: Harvatek Corporation, Hsin Chu (TW)

( * ) Notice: Subject to any disclaimer, the term of this patent is extended or adjusted under 35 U.S.C. 154(b) by 1533 days.

(21) Appl. No.: 11/476,165

(22) Filed: Jun. 28, 2006

(65) Prior Publication Data

US 2008/0000120 A1 Jan. 3, 2008

(51) Int. Cl.
*H01J 1/62* (2006.01)
*H01J 61/40* (2006.01)

(52) U.S. Cl. ..... 313/112; 313/512; 313/504

(58) Field of Classification Search ..... 313/112, 313/504, 506, 512
See application file for complete search history.

(56) References Cited

U.S. PATENT DOCUMENTS

2007/0069635 A1* 3/2007 Cok ..... 313/504

* cited by examiner

*Primary Examiner* — Joseph L Williams
(74) *Attorney, Agent, or Firm* — Rosenberg, Klein & Lee

(57) ABSTRACT

The present invention is related to a color-mixture display unit and an image display apparatus using the same, wherein the image display apparatus includes at least one color-mixture pixel which is pre-disposed at plates of a light box so that a pattern is formed. Each of the color-mixture pixels is equipped with a red filter, a green filter and a blue filter, or equipped with a black filter or equipped with a transparent filter. At least one color-mixture LED is disposed within the light box and provides a backlight for the color-mixture pixel. In this regard, the color-mixture LEDs are controlled by an image controller and provide various color light beams with the color-mixture pixels. In addition, arrangement of each color filter within the color-mixture pixel is utilized so that color-mixture effect of dynamic image is shown.

9 Claims, 4 Drawing Sheets

COLOR-MIXTURE DISPLAY UNIT AND IMAGE DISPLAY APPARATUS USING THE SAME

BACKGROUND OF THE INVENTION

1. Field of the Invention

The present invention relates to a color-mixture display unit and image display apparatus using the same, and in particular, to a color-mixture display unit that utilizes color-mixture LEDs and color filters to provide dynamic images.

2. Description of Related Art

Different types of shop signs exist in our everyday life. For example, advertising posters, advertising light boxes, projector shop signs, neon lights or wall paintings etc. They are used to promote merchandise, and big-sized shop signs such as neon light towers are regarded as symbol of development and prosperity.

However, neon light shop signs include neon light tubes, neon light transformers (inductive, electronic), circuit breaker boxes, mechanical parts of neon light and lightening conductor. Most of conventional neon light shop signs provide singular and monotonous images and cannot provide 3-dimensional or dynamic images. As shown in FIG. 1, it illustrates a perspective view of a light box shop sign 6 in the prior art.

Thus, there is a need for a color-mixture display unit and an image display apparatus using the same.

SUMMARY OF THE INVENTION

It is an object of the present invention to provide a color-mixture display unit and an image display apparatus using the same. The color-mixture display unit includes a color-mixture pixel and a color-mixture light-emitting diode (LED). The color-mixture pixel includes a red filter, a green filter and a blue filter, or includes a black filter or a transparent filter. The color-mixture LED is disposed corresponding to the color-mixture pixel and used as a backlight module for the color-mixture pixel. Thus, the color-mixture LED provides a various color light beams with the color-mixture pixel and arrangement of each color filter within the color-mixture pixel is utilized so that color-mixture effect is shown.

An image display apparatus includes a light box, at least one color-mixture pixel and at least one color-mixture light-emitting diode (LED). The color-mixture pixels are pre-disposed at a plate of the light box so that a pattern is formed on the plate. Each color-mixture pixel includes a red filter, a green filter and a blue filter, or includes a black filter or a transparent filter. The color-mixture LEDs are used as a backlight module for the color-mixture pixels. In this regard, the color-mixture LEDs are controlled by an image controller and provide a various color light beams with the color-mixture pixels. In addition, arrangement of each color filter within the color-mixture pixel is utilized so that color-mixture effect of dynamic image is shown.

BRIEF DESCRIPTION OF THE DRAWINGS

The present invention can be fully understood from the following detailed description and preferred embodiment with reference to the accompanying drawings, in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
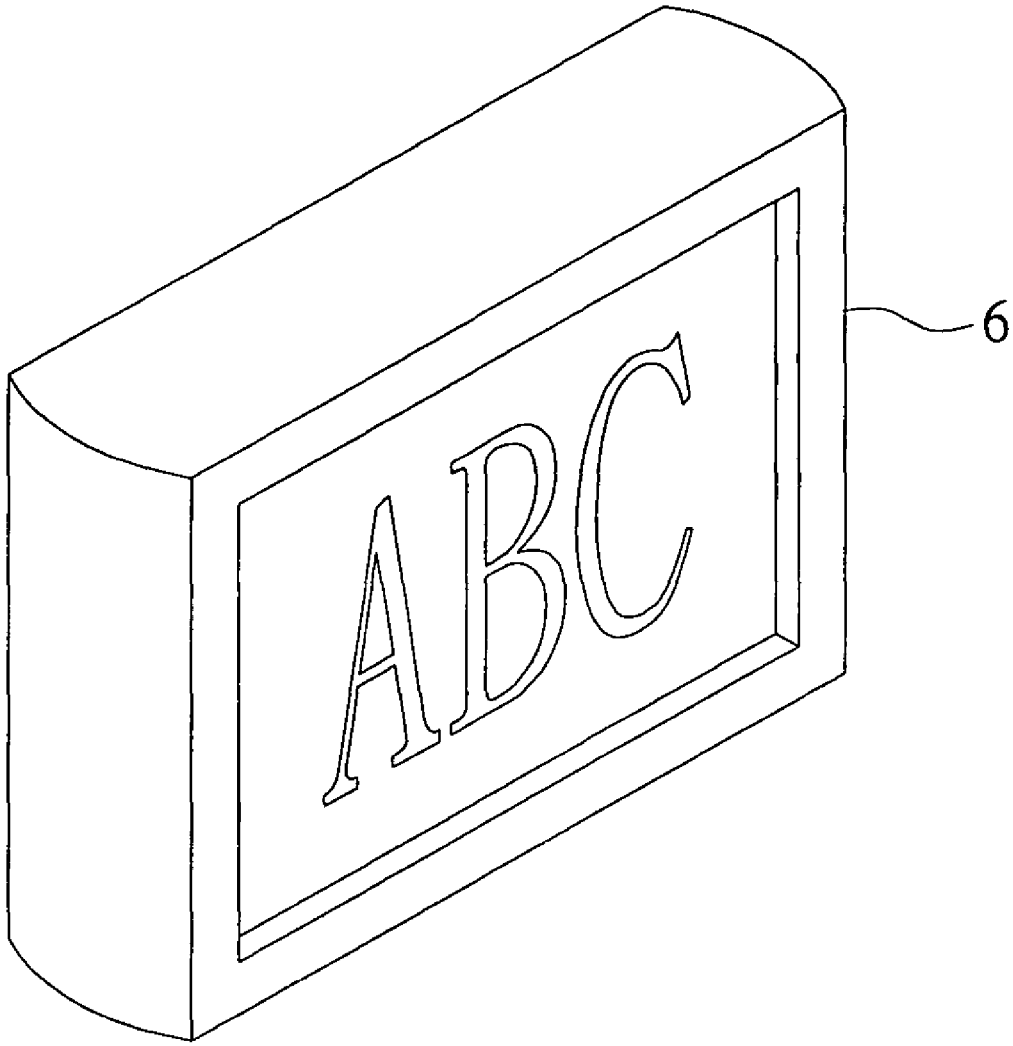
FIG. 1 PRIOR ART
FIG. 1 is a perspective view of a light box shop sign in the prior art.
Figure 2:
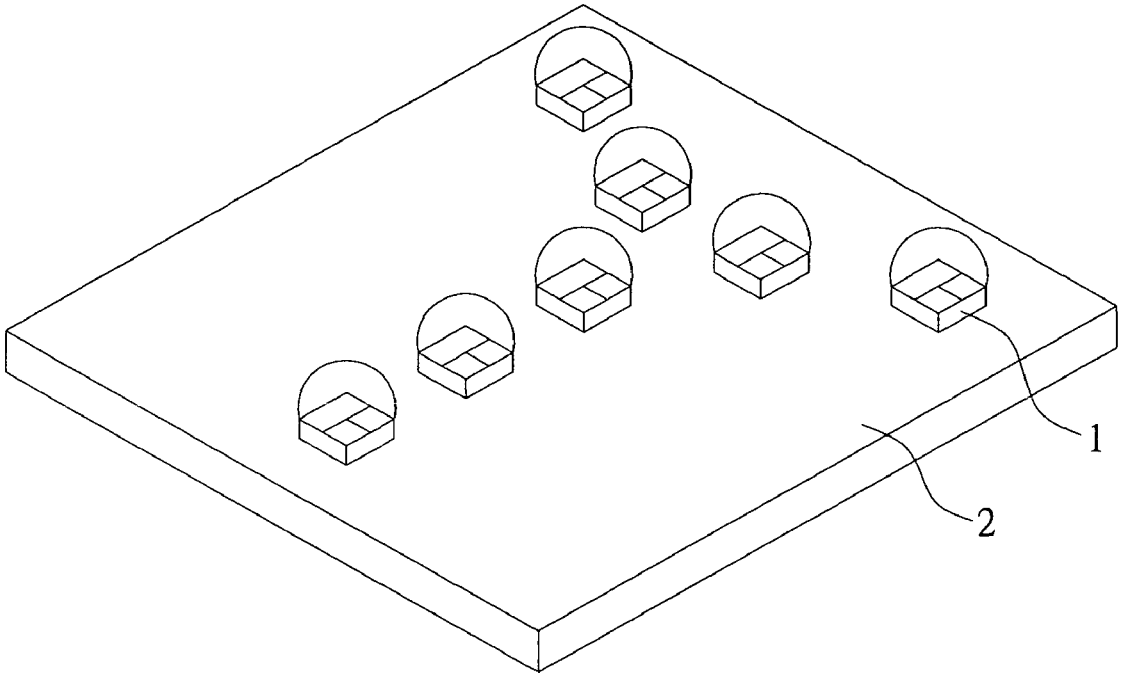
FIG. 2 is a perspective view of an arrangement of color-mixture LEDs according to present invention.

Reference is made to FIG. 2. FIG. 2 illustrates a perspective view of an arrangement of color-mixture LEDs according to present invention. The color-mixture light-emitting diodes (LEDs) 1 are coupled in series and disposed at a printed circuit board 2 and are controlled by an image controller (not numeral). Each of the color-mixture LEDs 1 includes light-emitting diodes which respectively emit red light beams, green light beams and blue light beams. In addition, these diodes are disposed together by package process. Each of the color-mixture LEDs 1 are used to respectively adjust wavelength and brightness of light beams from these light-emitting diodes and mixes red lights, green light beams, green light beams and blue light beams to generate desirable colors. As shown in FIG. 2, the color-mixture LEDs 1 are arranged into a Y-shaped pattern, and the image controller is electrically connected with the color-mixture LEDs 1 through the printed circuit board 2 and is used to regulate light beam outputs of each of the color-mixture LEDs 1.

Figure 3:
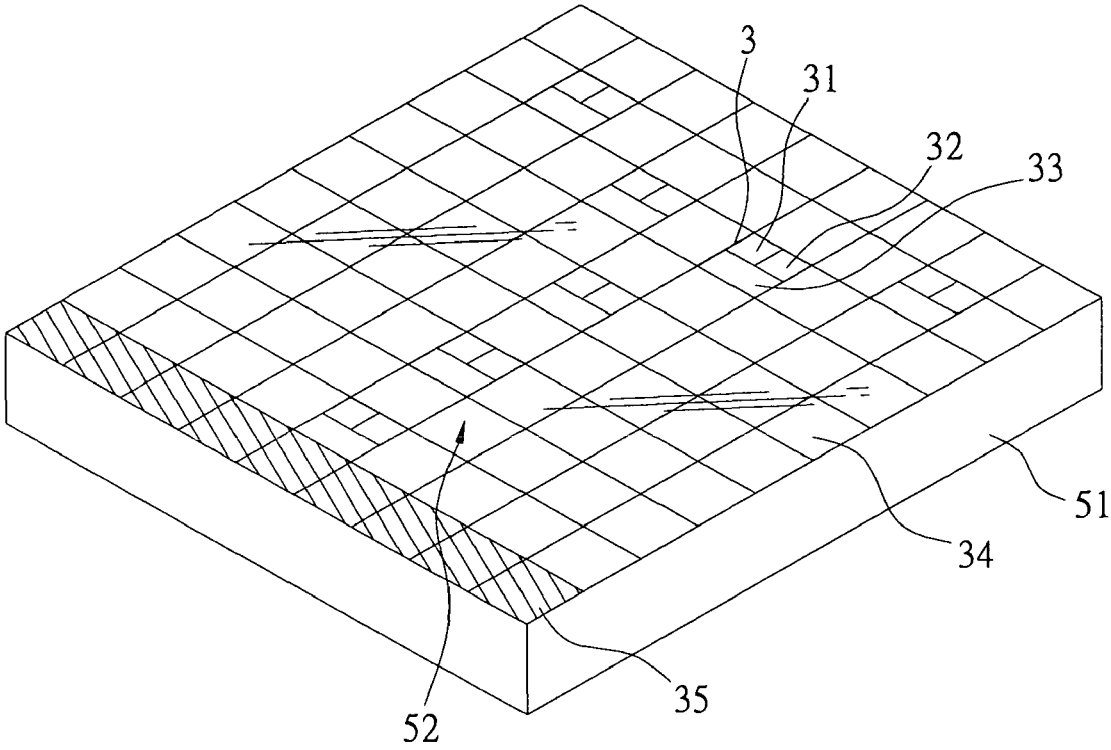
FIG. 3 is a perspective view of an arrangement of color-mixture pixels according to present invention.

Reference is made to FIG. 3. FIG. 3 illustrates a perspective view of an arrangement of color-mixture pixels according to present invention. At least one color-mixture pixel 3 is pre-disposed at a plate of a light box 51 so that a pattern 52 is formed on the plate. Each of the color-mixture pixels 3 includes a red filter 31, a green filter 32 and a blue filter 33. And, these color filters are made of material with high light transmittance. In addition, the color-mixture pixels 3 further are arranged into a black filter 35 or a transparent filter 34. As shown in FIG. 3, the black filter 35 is used to mask all light beams no matter what color light beams are emitted from the backlight module. The transparent filter 34 is transparent for all light beams no matter what color light beams are emitted from the backlight module.

Figure 4:
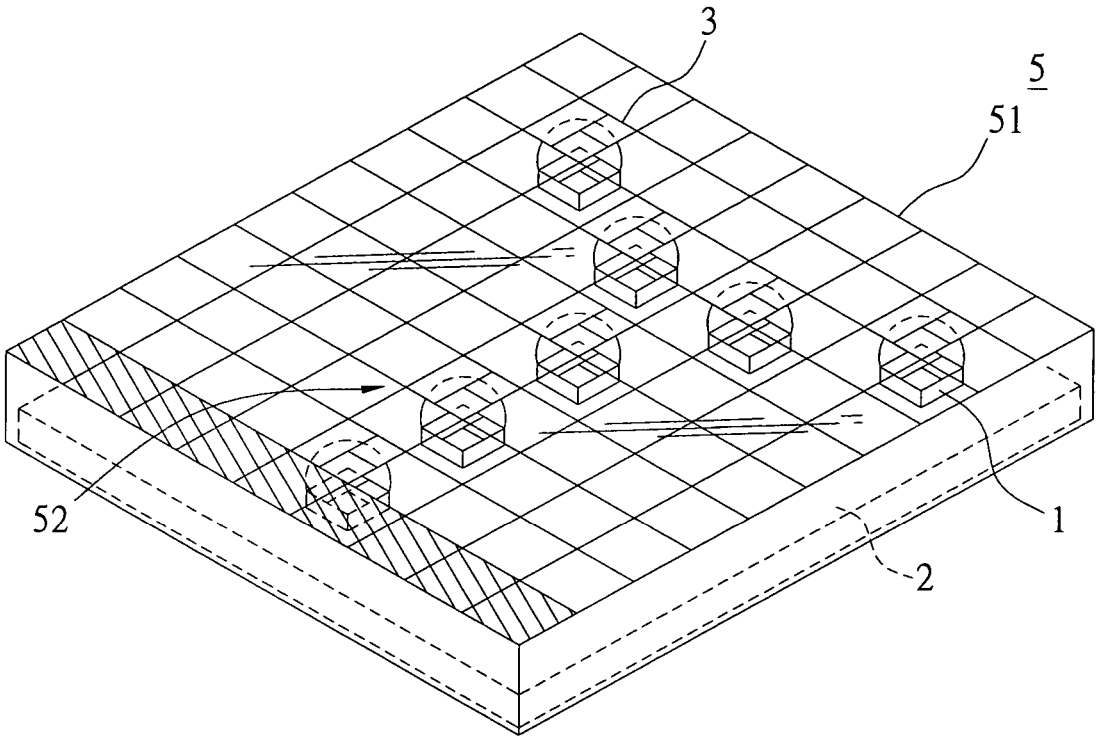
FIG. 4 is a perspective view of an image display apparatus according to the present invention.

Reference is made to FIGS. 2, 3 and 4. FIG. 4 illustrates a perspective view of an image display apparatus 5 according to the present invention. The image display apparatus 5 is consisted of an arrangement of color-mixture LEDs of FIG. 2 and an arrangement of color-mixture pixels of FIG. 3.

The image display apparatus 5 of the present invention includes a light box 51, at least one color-mixture pixel 3 and at least one color-mixture light-emitting diode (LED) 1. At least one color-mixture pixel 3 is pre-disposed at the plate of a light box 51 so that a pattern 52 is formed on the plate. The color-mixture LEDs 1 are disposed within the light box 51 and corresponds with the color-mixture pixels 3 so that the color-mixture LEDs 1 are used as the backlight module for the color-mixture pixels 3. In this regard, the image display apparatus 5 is controlled by the image controller and provide various color light beams with the color-mixture pixels 3. In addition, arrangement of each color filter within the color-mixture pixel 3 is utilized so that color-mixture effect of dynamic image is shown. In addition, the black filter 35 or the transparent filter 34 are configured by the color-mixture pixels 3.

According to the present invention, the image display apparatus 5 are pre-disposed at the plate of the light box 51 corresponding to filters of each of the color-mixture pixels 3 so that the pattern 52 is formed. The image display apparatus 5 utilizes the image controller (not numeral) to adjust wavelength and brightness of light beams from these light-emitting diodes of each of the color-mixture pixels 3. Thus, the light beams can penetrate through the pattern 52 of the plates of the light box 51 so that the color-mixture effect of dynamic image is shown.

According to another embodiment of the present invention, the color-mixture LEDs 1 are disposed within the light box 51 and are used as a backlight module. The color-mixture LEDs 1 can emit red light beams, green light beams or blue light beams simultaneously. These light beams are emitted toward the pattern 52 and arrangement of each color filter within the color-mixture pixel 3 is utilized so that dynamic image of the pattern 52 is shown.

Reference is made to FIGS. 2 and 3 again. The image display apparatus 5 of the present invention includes a plurality of color-mixture display units. Each of the color-mixture display units includes a color-mixture pixel 3 and a color-mixture LED 1. The color-mixture pixel 3 includes a red filter 31, a green filter 32 and a blue filter 33. The color-mixture LED 1 is disposed corresponding to the color-mixture pixel 3 and is used as the backlight module for the color-mixture pixel 3. In this regard, the color-mixture LED 1 provides various color light beams with the color-mixture pixel 3 and arrangement of each color filter within the color-mixture pixel 3 is utilized so that color-mixture effect is shown. In addition, the color-mixture pixels 3 further are arranged into a black filter 35 or a transparent filter 34.

In summary, the present invention utilizes a plurality of color-mixture display units including the color-mixture pixel 3 and the color-mixture LED 1 so that a pattern 52 is formed. The color-mixture display units are controlled by the image controller so that color-mixture effect is shown. Thus, the present invention overcomes shortcomings of most of conventional neon light shop signs: singular and monotonous images are generated and 3-dimensional or dynamic image are not available.

While the invention has been described with reference to the preferred embodiments, the description is not intended to be construed in a limiting sense. It is therefore contemplated that the appended claims will cover any such modifications or embodiments as may fall within the scope of the invention defined by the following claims and their equivalents.

What is claimed is:

1. A color-mixture display unit, comprising:

a color-mixture pixel, including at least one filter; and a color-mixture light-emitting diode (LED), disposed corresponding to the color-mixture pixel and used as a backlight module for the color-mixture pixel, wherein each color-mixture LED includes three independent LED devices which are disposed together by package process for respectively emitting red light beams, green light beams and blue light beams;

wherein the color-mixture LED provides a various color light beams with the color-mixture pixel and arrangement of each color filter within the color-mixture pixel is utilized so that color-mixture effect is shown.

2. The color-mixture display unit as claimed in claim 1, wherein the color-mixture pixel is equipped with a red filter, a green filter and a blue filter.

3. The color-mixture display unit as claimed in claim 1, wherein the color-mixture pixel is equipped with a black filter.

4. The color-mixture display unit as claimed in claim 1, wherein the color-mixture pixel is equipped with a transparent filter.

5. An image display apparatus, comprising:

a light box;

at least one color-mixture pixel, pre-disposed at plate of the light box so that a pattern is formed on the plate and one of the one color-mixture pixels including at least one filter; and at least one color-mixture light-emitting diode (LED) positioned within the light box corresponding to the color-mixture pixels and used as a backlight module for the color-mixture pixels, wherein each color-mixture LED includes three independent LED devices which are disposed together by package process for respectively emitting red light beams, green light beams and blue light beams;

wherein the color-mixture LEDs provide various color light beams with the color-mixture pixels, and arrangement of each color filter within the color-mixture pixel is utilized so that color-mixture effect of dynamic image is shown.

6. The image display apparatus as claimed in claim 5, wherein the color-mixture pixel is equipped with a red filter, a green filter and a blue filter.

7. The image display apparatus as claimed in claim 5, wherein the color-mixture pixel is equipped with a black filter.

8. The image display apparatus as claimed in claim 5, wherein the color-mixture pixel is equipped with a transparent filter.

9. The image display apparatus as claimed in claim 5, wherein the color-mixture light-emitting diodes are coupled in series and disposed at a printed circuit board and are controlled by an image controller.

* * * * *